US005964154A

United States Patent [19]

Michalik

[11] Patent Number: 5,964,154

[45] Date of Patent: Oct. 12, 1999

[54] FOLDING DEVICE

[75] Inventor: Horst Bernhard Michalik, Höchberg, Germany

[73] Assignee: Koenig & Bauer-Albert Aktiengesellschaft, Wurzburg, Germany

[21] Appl. No.: 09/068,111

[22] PCT Filed: Nov. 7, 1996

[86] PCT No.: PCT/DE96/02128

§ 371 Date: May 6, 1998

§ 102(e) Date: May 6, 1998

[87] PCT Pub. No.: WO97/17274

PCT Pub. Date: May 15, 1997

[30] Foreign Application Priority Data

Nov. 8, 1995 [DE] Germany ..... 195 41 580

[51] Int. Cl.[6] ..... B41F 13/24; B41F 1/10

[52] U.S. Cl. ..... 101/247; 270/21.1; 270/50; 493/444; 493/445

[58] Field of Search ..... 101/212, 247; 270/20.1, 21.1; 493/442, 443, 444, 445

[56] References Cited

U.S. PATENT DOCUMENTS

| | | | |
|---|---|---|---|
| 3,691,956 | 9/1972 | James | 101/247 |
| 3,954,258 | 5/1976 | Skipor et al. . | |
| 4,190,242 | 2/1980 | Bolza-Schonemann | 270/50 |
| 5,057,064 | 10/1991 | Michalik . | |
| 5,080,339 | 1/1992 | Hirahara . | |
| 5,147,276 | 9/1992 | Stäb . | |

FOREIGN PATENT DOCUMENTS

| | | |
|---|---|---|
| 0400527 | 12/1990 | European Pat. Off. . |
| 2611820 | 10/1976 | Germany . |
| 3838314 | 5/1990 | Germany . |
| 4018709 | 1/1991 | Germany . |
| 4020937 | 1/1992 | Germany . |
| 07237812 | 9/1995 | Japan . |

*Primary Examiner*—Eugene Eickholt
*Attorney, Agent, or Firm*—Jones, Tullar & Cooper, P.C.

[57] ABSTRACT

A device for accurately setting a roller gap of a folding device of a rotary web-fed press uses a rotatable threaded spindle with contrarotating threads at both of its ends. A drivable differential screw gear mechanism is associated with each threaded spindle end and operates to pivot two-armed levers that support the folding rollers to thus vary the roller gap.

16 Claims, 2 Drawing Sheets

FOLDING DEVICE

FIELD OF THE INVENTION

The present invention relates to a folding device of a rotary printing press. More particularly, the present invention is directed to a device for setting a cylinder gap of a longitudinal folding device. Double levers which support the folding cylinder are pivoted by a drivable differential screw mechanism.

DESCRIPTION OF THE PRIOR ART

A prior art folding device has become known from DE 40 20 937 A1, whose folding cylinders are rotatably seated on first ends of respectively double-armed levers. Second ends of the double-armed levers are hingedly connected with a threaded spindle, which has opposed screw threads on its ends. Setting of the cylinder gap is performed by turning the threaded spindle in one or the other direction.

It is known from DE 38 38 314 A1 to determine the thickness of the folded product by means of a thickness measuring device and to supply it to a production computer, for example arranged in the machine control device. The computer can be used to accomplish an automatic setting of the cylinder gap.

JP 07-237812 discloses a device for adjusting a cylinder gap of a folding device. The folding cylinders are seated in double-armed levers, which are displaced by means of a threaded spindle.

DE 40 18 709 A1 and EP 04 00 527 A2 show folding devices, wherein the distance between the folding cylinders can be changed by means of a threaded spindle.

SUMMARY OF THE INVENTION

Its is the object of the present invention to create a cylinder gap setting device by means of which it is possible to set a folding cylinder gap with a high degree of accuracy or sensitivity.

This object is attained in accordance with the invention by providing a pivotable double lever which supports one of the folding cylinders. At least one drivable differential screw mechanism is provided as the drive for pivoting the lever to adjust the folding cylinder gap.

The advantages which can be achieved by means of the present invention in particular reside in that a high setting accuracy of the folding cylinder gap is achieved because of the use of a differential screw mechanism. By means of the possibility of using relatively coarse, i.e. sturdy screw threads with a pitch between 2.0 and 3.5 millimeters, as well as the employment of springs, it is possible to absorb suddenly appearing additional forces occurring between the folding cylinders, for example because of product jams, without causing damage. Following the entry of the paper thickness and number of pages, it is also possible to set the folding cylinder gap to a value determined by the production computer. In the process, corrections of the folding cylinder distance, which become necessary because of the appearance of wear of the folding strips on the folding cylinders, can be made in a simple manner. The setting device in accordance with the invention is suitable for use with roller or blade folding devices, and can also be used for cylinder adjustment in cylinder folding devices. There is also the option of providing a manual operation, which can be controlled by a graduation, in place of a motor drive.

BRIEF DESCRIPTION OF THE DRAWINGS

A preferred embodiment of the present invention is represented in the drawings and will be described in more detail in what follows. Shown are in.

DESCRIPTION OF THE PREFERRED EMBODIMENTS

Figure 1:
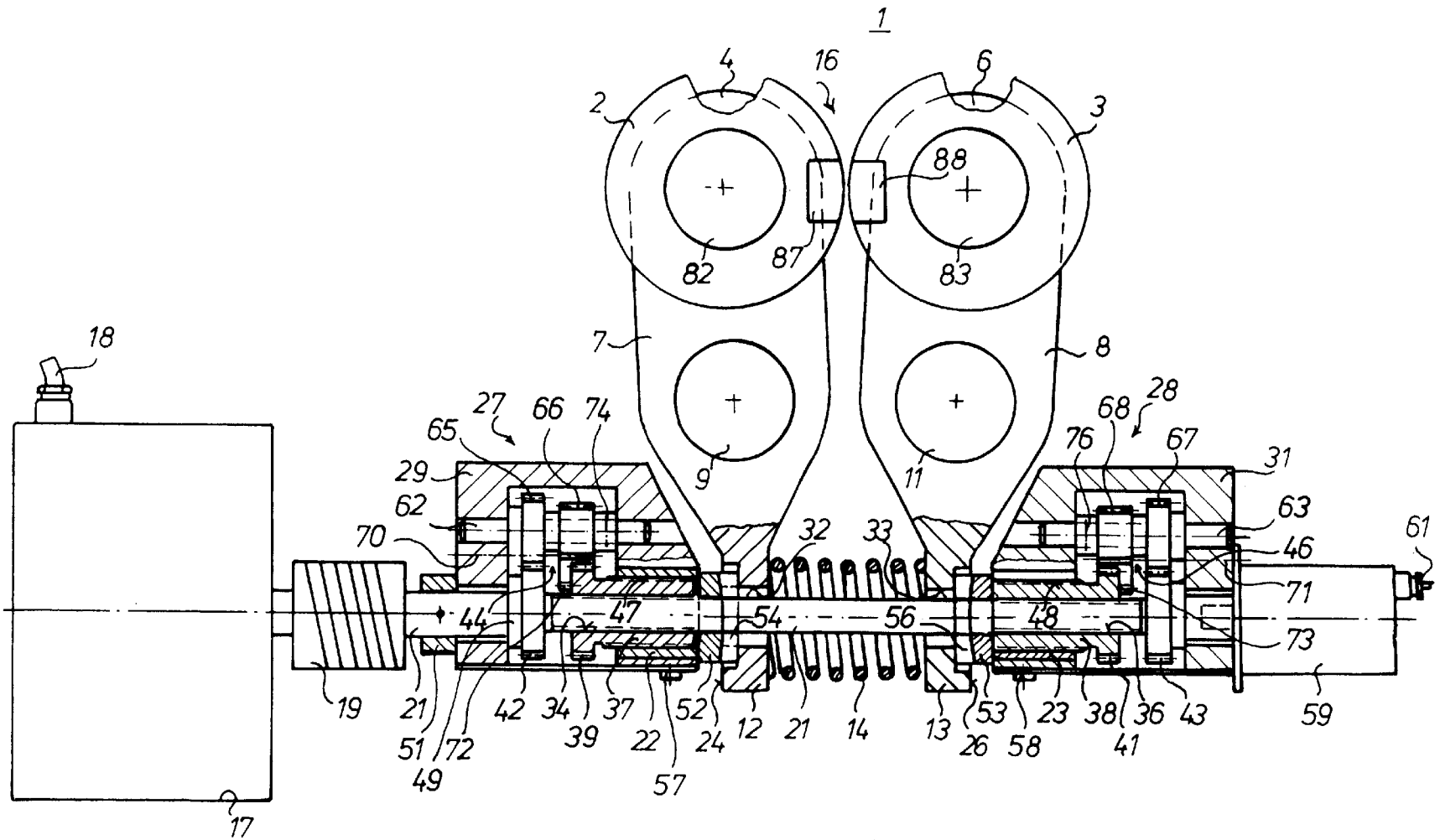
FIG. 1, a sectional representation of a first preferred embodiment of a cylinder gap setting device in accordance with the present invention.

A folding device 1 of a rotary printing press, as seen in FIG. 1, has a left and a right folding cylinder 2, 3. The two folding cylinders 2, 3 are drivingly seated with each of their two ends respectively at first ends 4, 6 of each of two-armed levers or double lever 7, and 8, respectively. The seating of the folding cylinders 2, 3 has only been represented and described at one end in FIG. 1. It will be understood that the second ends of each of the folding cylinders 2 and 3 are supported by two-armed or double levers which are the same as levers 7 and 8 shown in FIG. 1. Both double levers 7, 8 are pivotably seated by means of pins 9, 11, fixed in place in the lateral frame. A helical spring 14 is arranged between the two second ends 12, 13 of the two double levers 7, 8, and the cylinder gap 16 can be set against the force of spring 14.

To generate this spring force, a set of gears, seated fixed in the frame, for example a servo motor 17 with an electrical connection 18 is provided, which drives a threaded spindle 21, that is seated fixed against translation in the frame, via a known coupling 19. As will be described later, the threaded spindle 21 acts with respectively each one of two detent sleeves 22, 23 against the outsides or outer surfaces 24, 26 of the two second ends 12, 13 of the double levers 7, 8, so that the cylinder gap 16 is created against the force of the helical spring 14. The threaded spindle 21 is rotatably seated at its two ends in respective housings 29, 31 fixed in the frame, each of which receives a set of gears 27, 28, the left component in each left and right component set being always mentioned first. Each set of gears 27, 28 is designed as a differential screw mechanism, i.e. for setting the cylinder gap 16, a reduced linear movement is generated from a rotating movement of the set of gears. Here, the threaded spindle 21 is guided in elongated holes 32, 33, which are located in the flattened second ends 12, 13 of double levers 7, 8, respectively.

Each set of gears 27, 28 indicates a right hand screw thread 34, or respectively a left hand screw thread 36 on its associated left or right portion of the threaded spindle 21, each with an initial pitch of two millimeters, for example. A movable threaded sleeve 37, 38 is arranged on the respective threaded element 34, 36 of the threaded spindle 21, each with an internal screw thread corresponding in type and dimensions to the right screw thread 34, or respectively the left thread 36 of the left or right portion of the threaded spindle 21 with the initial pitch. On its side remote from the double lever, each threaded sleeve 37, 38 is fixedly connected with, or carries, a power take-off gear wheel 39, 41. On each of its ends, the threaded spindle 21 has a spindle drive gear wheel 42, 43, which is fixedly connected with it. The two gear wheels 39, 42 and 41, 43 on the left and right ends of spindle 21 are connected by means of a set of gears 44, 46, which reverses the direction of rotation so that, for example, with a left or counterclockwise turning of the threaded spindle 21 as viewed from the side 17, 19 of the set of gears, the threaded sleeve 37, 38 makes a right turn. The set of gears 44, 46, which reverses the direction of rotation, each respectively consists of two gear wheels 65, 66, or respectively of two gear wheels 67, 68, which are fixed on a shaft 62, 63, which is seated fixed in the frame, wherein the first gear wheel 65, 67 is arranged so that it can mesh with the drive gear wheel 42, 43 fastened on the threaded spindle 21. The second gear wheel 66, 68 fastened on the shaft 62, 63 is in engagement with the power take-off gear wheel 39, 41 located at the threaded sleeve 37, 38 via an intermediate gear wheel 72, 73 arranged on a shaft 70, 71, which is seated fixed on the frame.

The second gear wheel 66, 68 located on the shaft 62, 63 is arranged so that it can be interlockingly connected, for example by means of a screw 74, 76, with the shaft 62, 63.

Each threaded sleeve 37, 38 has an external screw thread 47, 48, which is designed to turn in the same direction as the internal screw thread 34, 36 also as a right screw thread 47, or respectively a left screw thread 48. This external screw thread 47, 48 respectively has a second, larger pitch, for example of 3.5 millimeters, in contrast to the internal screw thread 34, 36 of the threaded sleeve 37, 38 arranged coaxially on the threaded spindle 21. The already mentioned detent sleeve 22, 23, which is provided with an internal screw thread 47, 48 and which is seated coaxially on the threaded sleeve 37, 38, is in engagement with the external screw thread 47, 48 of the threaded sleeve 37, 38. On its end, which faces the outside 24, 26 of the second end 12, 13 of the double lever 7, 8, each detent sleeve 22, 23 has a circularly-shaped, convexly arched detent 52, 53. The detent 52, 53 respectively presses against a circularly-shaped abutment 54, 56, which encloses the threaded spindle 21 and which is concave. The abutment 54, 56 is also designed to be circularly-shaped and is respectively arranged in a recess located on the outside 24, 26 of the second end 12, 13 of the double lever 7, 8. In this way each detent sleeve 22, 23 acts against the second end 12, 13 of the double lever 7, 8.

The detent sleeve 22, 23 is secured against relative rotation by means of an anti-twisting device, for example a pin 57, 58, moving in a groove fixed on the housing, and thus detent sleeve 22, 25 moves only in the axial direction. A position indicator 59, for example a rotation sensor with an electrical connection 61, is arranged on the housing 31 of the right set of gears 28. The indicator is interlockingly connected with the threaded spindle 21. The threaded spindle 21 is secured against axial displacement by means of a collar 49, resting against the housing 29, and by a set collar 51.

As already mentioned, a threaded spindle 21 represented in FIG. 1 with the two sets of gears 27, 28, seated fixed in the frame, and the servo motor 17 and coupling 19, is respectively arranged on both ends of the folding cylinders 2, 3, so that the cylinder gap 16 can be set so that its extends parallel with the axes of rotation of the folding cylinders 2, 3, or extends in a wedge shape.

The device in accordance with the present invention operates as described hereinafter. If the threaded spindle 21 is turned to the left, viewed from the side of the servo motor 17, the threaded sleeve 37 is turned to the right via the set of gears 44, which reverses the direction of rotation, and the power take-off gear wheel 39. At a gear ratio of the set of gears 42, 65, 66, 72, 39 of 1:1, and with the mentioned pitch of the right screw thread 34 on the threaded spindle 21 of 2 mm, the threaded sleeve 37 absolutely moves by 4 mm in the direction toward the double lever 7 during one rotation of the threaded spindle 21. However, simultaneously the detent sleeve 22, which is secured against rotation by means of the pin 57 in the groove fixed on the housing, moves in the opposite direction of the double lever 7 because of its right-hand screw thread. With the screw thread pitch of the screw thread 47 of 3.5 mm, the detent sleeve 22 therefore moves by a difference amount of 0.5 mm in the direction toward the double lever 7.

Since, with the same direction of rotation of the threaded spindle 21, the screw threads 36, 48 in the right set of gears 28 are respectively designed to turn opposite each other, the right detent sleeve 23 also moves by a difference amount of 0.5 mm in the direction toward the double lever 8. The cylinder gap 16 is enlarged in this way.

If the threaded spindle 21 is turned to the right, viewed from the side of the servo motor 17, the detents 52, 53 move away from each other and the cylinder gap 16 is reduced. The helical spring 14 provides a setting of the detents 52, 53 free from play. In this case the contact force of the helical spring 14 has been set such that, in case of a wrong setting or a product interference, the folding cylinder gap 16 is set automatically to conform to the thickness of the incoming product. The folding cylinder system is protected against breaking in this way.

For the purpose of zero setting the cylinder gap center, the position of the detents 52, 53, and thus the ends 12, 13 of the double levers 7, 8, can be changed by turning the gear wheels 65, 67. To this end the gear wheels 66, 68 are taken out of engagement with the shaft 62, 63 by loosening the screws 74, 76.

Because of this possibility of fine setting the cylinder gap 16, it is possible to employ a comparatively coarse gear, whose flanks are dimensioned in such a way that the forces occurring in the folding cylinder system can be absorbed without damage. Setting of the cylinder gap 16 can be performed by hand, using a handwheel arranged in place of the servo motor 17, wherein a graduation or scale is provided instead of the rotation sensor 59. Setting of the cylinder gap 16 advantageously takes place by means of the servo motor 17, for example via the production computer in the machine control device, wherein the actual position of the threaded spindle 21, and therefore also the actual size of the cylinder gap 16 is reported back by means of the rotation sensor 59. In this way, a high setting accuracy is also provided for a repeat operation, since only a slight change in the width of the cylinder gap 16 takes place per revolution of the threaded spindle. An automatic setting of the cylinder gap 16 by means of the production computer can take place if the paper thickness and the number of pages of the product are entered into the production computer. However, it is also possible to determine the thickness of the folded product by means of a thickness measuring device known for example from DE 38 38 314 A1 and to provide this to the production computer.

Figure 2:
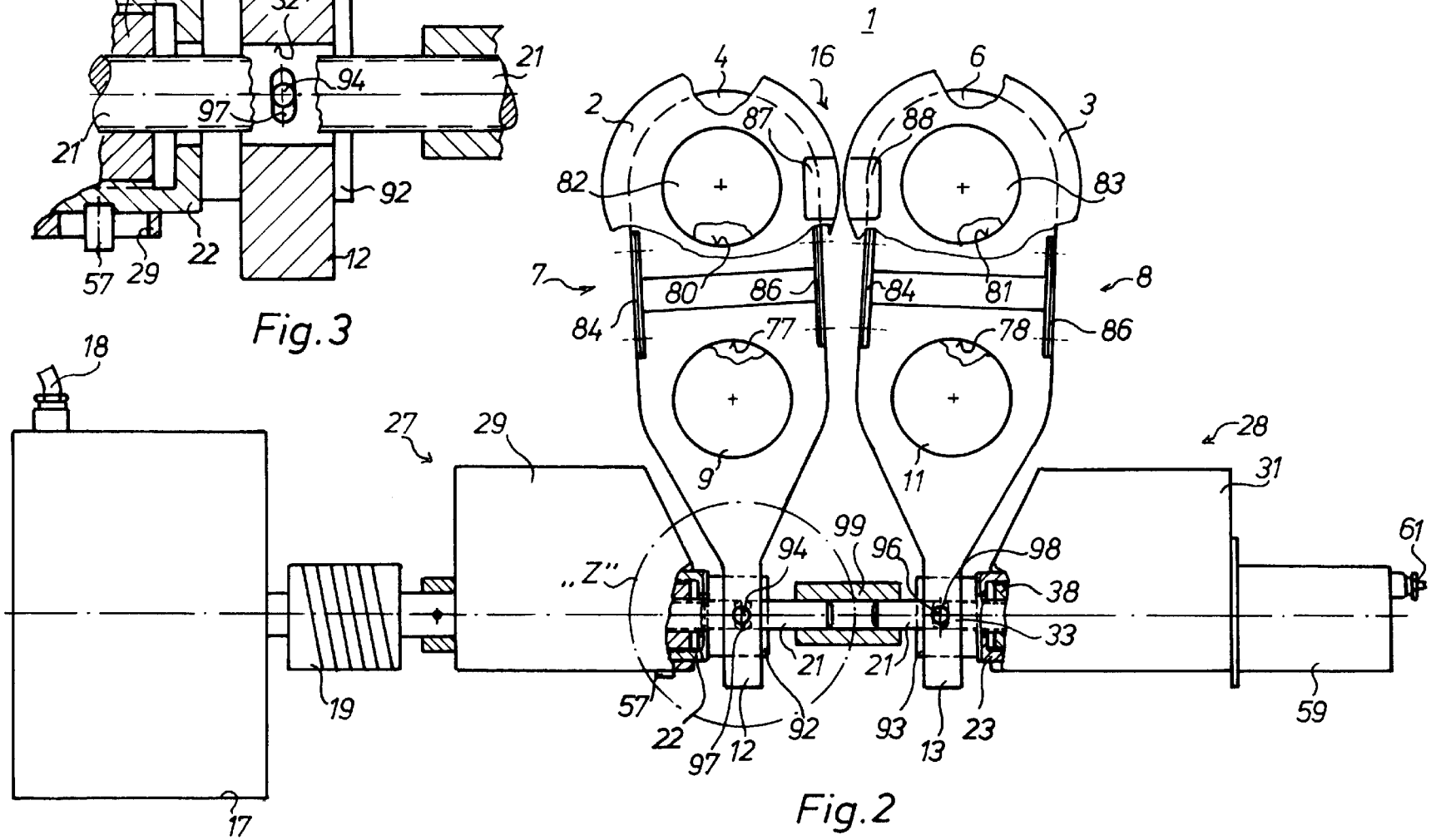
FIG. 2, a schematic representation of a second preferred embodiment of the present invention.

In accordance with a second preferred embodiment, each double lever 7, 8 is connected by elastic or flexible elements 84, 86 between its receptacle 77, 78 for the pin 9, 11, fixed in the frame, and its receptacle 80, 81 for the shaft journal 82, 83 of the folding cylinder 2, 3, all as may be seen in FIG. 2. These elastic or flexible elements 84, 86 are respectively designed as leaf spring 84, 86, for example.

Thus, a portion of the upper lever arm of each double lever 7, 8 is formed by the leaf springs 84, 86. Because of this, the portion of the double lever 7, 8 supporting the folding cylinder 2, 3 can be deflected in a direction parallel with the threaded spindle when placed under a load. The folding cylinder system is protected against damage in this way.

The folding cylinders 2, 3 can have exchangeable or replaceable folding strips 87, 88 in their shell surfaces, extending in an axis-parallel direction as seen in FIGS. 1 and 2.

Figure 3:
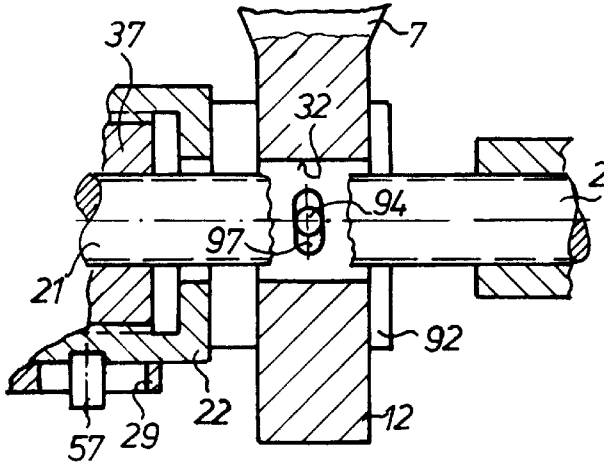
FIG. 3, the enlarged representation of a detail "Z" in FIG. 2.

On its side facing the second end 12, 13 of the double lever 7, 8, each detent sleeve 22, 23 can have a yoke end 92, 93, which is rigidly connected with the detent sleeve 22, 23, as seen in FIGS. 2 and 3. The yoke end 92, 93 is seated by means of a pin 94, 96 in a hole, in particular an elongated hole 97, 98 formed in the second end 12, 13 of the double lever 7, 8. Each second end 12, 13 of the double lever 7, 8 has an elongated hole 97, 98 for passing the threaded spindle 21 through.

The threaded spindle 21 in this embodiment is interrupted or divided between the two ends 12, 13 of the double lever 7, 8 and can be connected by means of a coupling 99. This coupling 99 can consist of a sleeve, which covers the ends of the divided threaded spindle 21 facing each other and locks them in place by means of clamping screws. The coupling 99 can be used for the zero setting of the cylinder gap center.

In accordance with a further preferred embodiment, a separate drive can be assigned to each double lever 7, 8. For example, each drive may consist of a servo motor 17 with a position indicator 59, a coupling 19 and a set of gears 27, 28, whose yoke end 92, 93 of the detent sleeve 22, 23, for example, have a hinged connection with the second end 12, 13 of the double lever 7, 8 such as seen in FIG. 2.

The servo motors 17 of the drives 17, 59, 19, 27; 17, 59, 19, 29 can also be designed in such a way that they can be synchronized with each other.

In accordance with yet another preferred embodiment, it is also possible to change the cylinder gap 16 by means of only one adjustable folding cylinder 2 or 3. For this, only one servo motor 17 with the coupling 19 and the set of gears 27 or 29 is required, wherein the detent sleeve 22 or 23 acts against a second end 12 or 13 of only one of the double levers 7 or 8. When using a helical spring as depicted in FIG. 1, a second double lever 7 or 8 rests with its second end 12 or 13 against a detent fixed on the frame,—or the end 12 or 13 is seated fixed in the frame—if using leaf springs 84, 86 as shown in FIG. 2.

While preferred embodiments of a folding device in accordance with the present invention have been set forth fully and completely hereinabove, it will be apparent to one of skill in the art that various changes in the type of printing press used, the folder which includes the folding cylinders, the type of web being folded and the like may be made without departing from the true spirit and scope of the present invention which is to be limited only by the following claims.

What is claimed is:

1. A device for setting a cylinder gap of a folding device comprising:

first and second spaced folding cylinders defining a cylinder gap;

first and second double levers having first and second ends, each of said folding cylinders being supported by a first end of an associated one of said first and second double levers;

means for pivotally supporting each of said first and second double levers intermediate into first and second ends; and at least one drivable differential screw mechanism for pivoting at least one of said pivotable double levers to vary said cylinder gap.

2. The device in accordance with claim 1, wherein a separate one of said drivable differential screw mechanisms is provided for each of said folding cylinders forming said cylinder gap.

3. The device in accordance with claim 2, wherein both of said drivable differential screw mechanisms have a common drive.

4. The device in accordance with claim 1, wherein said drivable differential screw mechanism includes a rotatable threaded spindle with a screw thread of a first pitch and which supports a threaded sleeve which is arranged to be rotatable in a direction opposite to said spindle and which has an additional external thread of a second pitch which is greater than said first pitch, and further wherein each of said threaded sleeves is in engagement with a detent sleeve which is arranged fixed against relative twisting and coaxially in respect to said threaded sleeve and acts in an axial direction on said threaded sleeve against said second end of one of said levers and which has an internal thread.

5. The device in accordance with claim 4, wherein said rotatable threaded spindle is rotatably seated at first and second ends, and has an oppositely turning screw thread at each of said first and second ends, said threaded sleeve as well as said detent sleeve being arranged on said threaded sleeve, and wherein each said detent sleeve is in operational connection with said second end of said associated one of said first and second double levers.

6. The device in accordance with claim 4, wherein said threaded sleeve arranged on said rotatable threaded spindle is arranged to be driven in said direction opposite said direction of rotation of said threaded spindle by a set of gears reversing said direction of rotation of said threaded spindle.

7. The device in accordance with claim 4, wherein said set of gears reversing said direction of rotation consists of first and second gear wheels seated on a shaft fixed in a housing, said first gear wheel being in engagement with a drive gear wheel fastened on said threaded spindle, said second gear wheel seated on said shaft being in engagement, via an intermediate gear wheel seated fixed with said housing, with a power take-off gear wheel which is rigidly connected with said threaded sleeve.

8. The device in accordance with claim 1, wherein a helical spring is arranged between said second ends of said first and second double levers.

9. The device in accordance with claim 4, wherein a servo motor, a coupling, as well as a position indicator are assigned to said threaded spindle.

10. The device in accordance with claim 1 wherein each of said double levers includes elastic elements between its first and second ends.

11. The device in accordance with claim 4 wherein each said detent sleeve supports a yoke end which is hingedly connected with said second end of said associated double lever.

12. The device in accordance with claim 4 wherein said threaded spindle can be connected by means of a coupling between said second ends of said double levers.

13. The device in accordance with claim 10 wherein said elastic elements are each embodied as a leaf spring.

14. The device in accordance with claim 1 wherein a separate drivable differential screw mechanism is assigned to said second end of each said double lever.

15. The device in accordance with claim 14 further wherein motors of said separate drivable differential screw mechanisms are synchronized with each other.

16. The device in accordance with claim 1 wherein said drivable differential screw mechanism is engageable with only one of said first and second double levers.

* * * * *